US005129776A

United States Patent [19]

Peng

[11] Patent Number: 5,129,776

[45] Date of Patent: Jul. 14, 1992

[54] ROADSIDE PARKING SYSTEM

[76] Inventor: Luke S. Peng, No. 8-4, Ta Hsing West Road, Sec. 1, Tao-Yuan City, Taiwan

[21] Appl. No.: 658,128

[22] Filed: Feb. 22, 1991

[51] Int. Cl.[5] ..... E04H 6/18

[52] U.S. Cl. ..... 414/228; 414/232; 414/252

[58] Field of Search ..... 414/228, 231, 232, 252, 414/253, 254, 227, 264, 495; 187/18

[56] References Cited

U.S. PATENT DOCUMENTS

| | | | |
|---|---|---|---|
| 2,015,607 | 9/1935 | Shinn | 414/228 X |
| 2,285,232 | 6/1942 | Sheehan | 414/264 |
| 2,878,998 | 3/1959 | Spencer | 414/228 X |
| 2,915,203 | 12/1959 | Kurmer | 414/232 X |
| 3,016,154 | 1/1962 | Ugolini et al. | 414/227 X |
| 3,323,617 | 6/1967 | Inuzuka et al. | 414/232 X |
| 4,898,509 | 2/1990 | Thunnissen | 414/495 |
| 4,971,506 | 11/1990 | Givati | 414/228 X |

FOREIGN PATENT DOCUMENTS

| | | | |
|---|---|---|---|
| 0038292 | 2/1990 | Japan | 414/253 |
| 0115474 | 4/1990 | Japan | 414/227 |

*Primary Examiner*—Robert J. Spar
*Assistant Examiner*—James Keenan
*Attorney, Agent, or Firm*—Wenderoth, Lind & Ponack

[57] ABSTRACT

An automatic roadside multi-storied parking system including collapsible parking racks each having a plurality of vertically spaced parking platforms and between each two parking racks a lift conveyer capable of ascending and descending stepwise to reach the level of each parking platform. The parking system is also equipped with an emergency ladder on one side of each rack for a person to climb up or down during an emergency. A wheeled moving device is provided on the bottom of each module of the system to assist in adjustment of the angle and direction of the individual modules and is spring-released to flip into a storage recess for the stability of the modules. Parking racks and lift conveyers are fitted and supported each on both sides thereof with lazy tong-type links and oil cylinders are provided for lifting and unfolding of the parking racks and for raising and lowering of the lift conveyer to or from the level of a selected parking platform.

2 Claims, 5 Drawing Sheets

ROADSIDE PARKING SYSTEM

BACKGROUND OF THE INVENTION

The present invention relates to a parking system and more particularly, to a multi-storied, collapsible roadside parking system.

Every major city in the world faces the same problem of congestion of cars and the difficulty in finding a parking place. How to relieve congestion due to cars and to obtain a parking place has constantly been a task for city planners. In recent years, people have concentrated on research in connection with car parking lots, especially multi-storied parking buildings. However, building of such parking buildings often requires a long time for construction at the work site and also there may be road blockage affecting the traffic in the surrounding area. In modern cities land has become so scarce and valuable that it is difficult to select a spacious and location-suitable place to build a parking building. For this reason, some people have suggested that parking lots or parking buildings should be located in suburban districts adjacent to cities. However, since land is so scarce and even when land can be acquired, location in a suburban district will still present many inconveniences to car-driving persons.

SUMMARY OF THE INVENTION

In view of the above, an increase of roadside parking seems the only way of solving the parking problem. However, to make best use of a limited space, this can only be done by development of the space to increase the parking spaces available therein. For this development, there must be a perfect system for parking in the restricted space.

The aim of the present invention is to provide a multi-storied, collapsible and removable roadside parking system that may be disposed in a place where originally only ground level roadside parking is available. The multi-storied type parking facility can replace the original ground level parking to increase the overall parking space. The facility can be provided with a multiplicity of roadside multi-storied parking platforms and the entire system is set up in advance and transported to the site where it can be readily spread out for use. There is thus no extended period needed for setting up construction at the site and also there is no damage to the road surface, and when the entire system is transported to the site, the system can be spread out and fixed in position within seconds and be immediately ready for use, and after use the system can be collapsed within seconds to be ready for removal.

With this aim in view, according to the present invention, there is provided a collapsible removable roadside parking system, comprising a collapsible parking rack having multi-storied parking platforms and a lift conveyer capable of being raised or lowered stepwise to the level of the parking platforms on each floor and an emergency ladder extending up and down the parking rack for use by people during an emergency; characterized in that the system has wheel means to facilitate positioning and removal of the modules of the system, and each collapsible parking rack is provided with a vacant platform display means to indicate the occupancy condition of parking platforms on each floor, and each of the parking platforms in the rack has mounted thereon a retardation controller and a toll meter. The toll meter is for counting the parking time and only when parking fees have been paid in full will the retardation controller be automatically withdrawn into storage and the car will then be released and free to leave the parking platform. The car lift conveyer is provided thereon with a lift fee collector and a caution curtain. The lift fee collector functions for the selection of a floor upon deposit of a coin and to actuate the lift conveyer to ascend or descend, and the caution curtain by action of a spring rolls up or drops down upon the ascent or descent of the lift conveyer to signal any waiting car on the ground level and searching for a vacant parking seat to wait because the lift conveyer is in the process of transporting a car and the person parking the car.

In the roadside parking system according to the present invention, various modules of the entire system are removably assembled in advance and when transported to the site and stretched out there, the system is ready for use. Because of this arrangement, there is no necessity for any construction on the site and also there is the advantage of not having to break any ground. Furthermore, because the stretching out of the facility can be completed in a short time, there is no need for blocking off the adjacent road as is the case with a construction site where it is frequently necessary to block traffic.

BRIEF DESCRIPTION OF THE DRAWINGS

The foregoing objects, features and advantages of the present invention will be best understood from the following detailed description of a preferred embodiment of the present invention illustrated in the drawings, wherein.

DETAILED DESCRIPTION OF THE PREFERRED EMBODIMENT OF THE INVENTION

Figure 1:
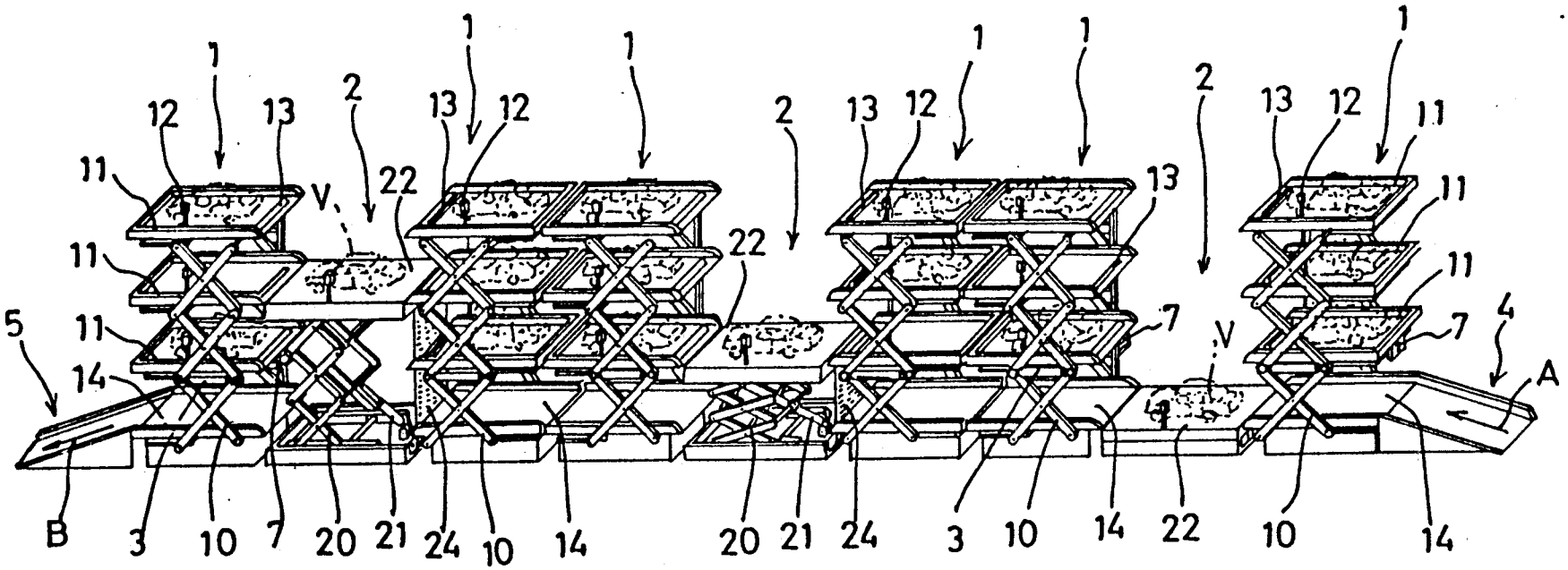
FIG. 1 is a perspective view of an automatic multi-storied roadside parking system according to the present invention.
Figure 2:
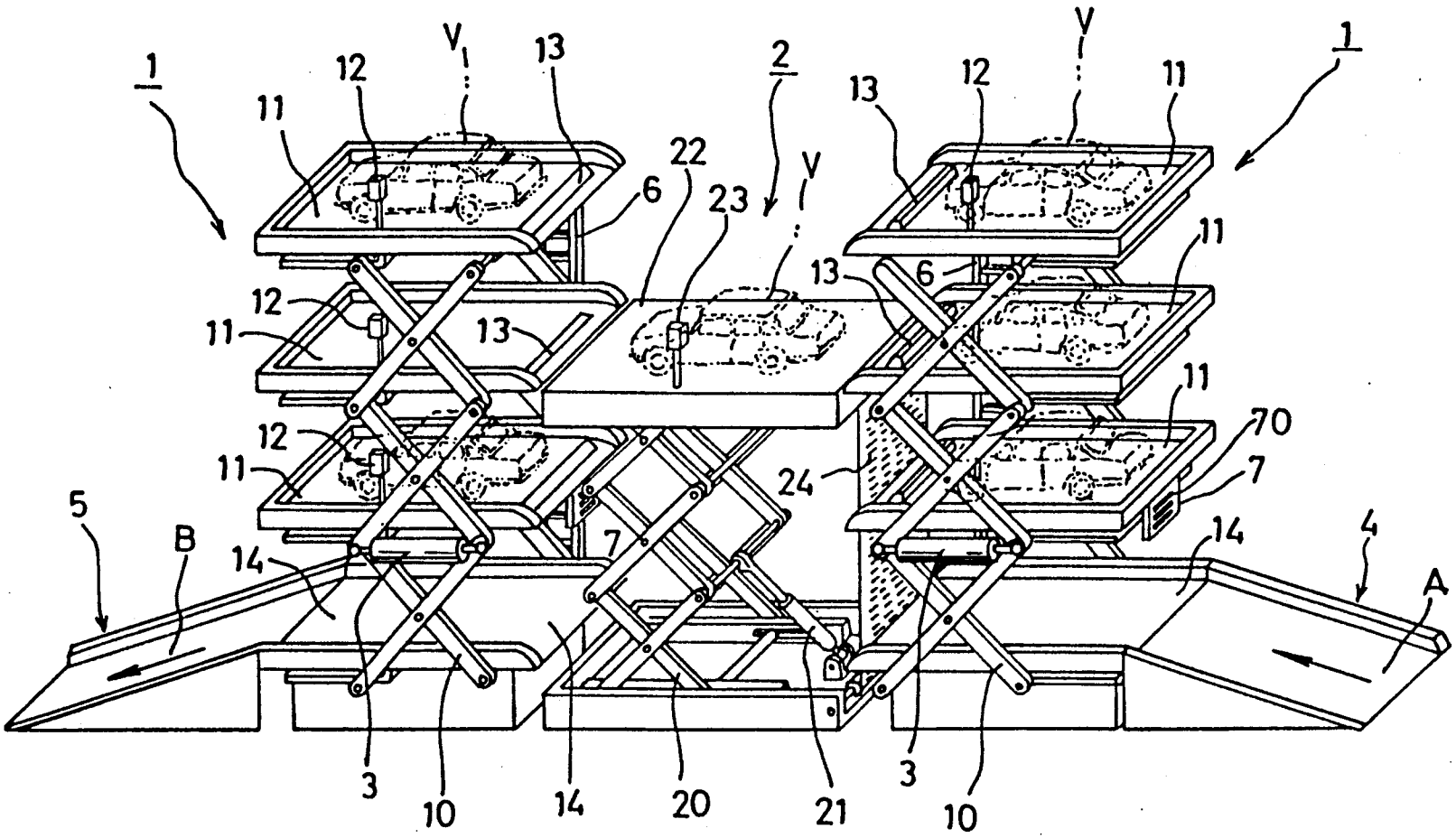
FIG. 2 is a perspective view, on an enlarged scale, of portion of the parking system of FIG. 1.

Referring now to FIGS. 1 and 2, there is shown an automatic multi-storied roadside parking system of the present invention, in which two spaced adjacent multi-storied parking racks 1 have a lift conveyer 2 therebetween which together with the racks 1 forms a unit, and in which the two multi-storied collapsible parking racks are provided having parking platforms 11 and each is provided with a vacancy display means 7. The vacancy display means 7 is located on the lower part of the second level platform of each of the parking racks 1 and is actuated by means responsive to car weight or by infrared rays. Upon arrival of a car V at a parking platform 11, this vacancy display means 7 shows a red light indicating that the particular parking platform 11 is now occupied and when there is no car parking on the platform, the vacancy display means 7 shows a green light indicating that the parking platform 11 is vacant and is ready for parking a car. In this way, a driver looking for a vacant parking platform is able to see clearly the message whether there is a vacancy or whether all the parking platforms 11 on each level are occupied. On each parking platform 11 is mounted a parking meter 12 and at the entrance/exit of the parking platform 11 is disposed a retardation controller 13. The parking meter 12 is for counting the number of hours a car has parked on the platform 11 as a basis for collecting the fees. When a car has entered the parking platform 11, the meter immediately starts counting the time and at the same time the retardation controller 13 is raised up to prevent the parked car from accidentally rolling off the parking platform 11. Next, when the car is to vacate the parking platform 11, all that is required is for the driver to insert the parking fees in the parking meter 12 and when the required parking fees have been paid, the retardation controller 13 automatically withdraws into storage. Simultaneously, the lift conveyer 2 is raised and only then is the car released.

Figure 3:
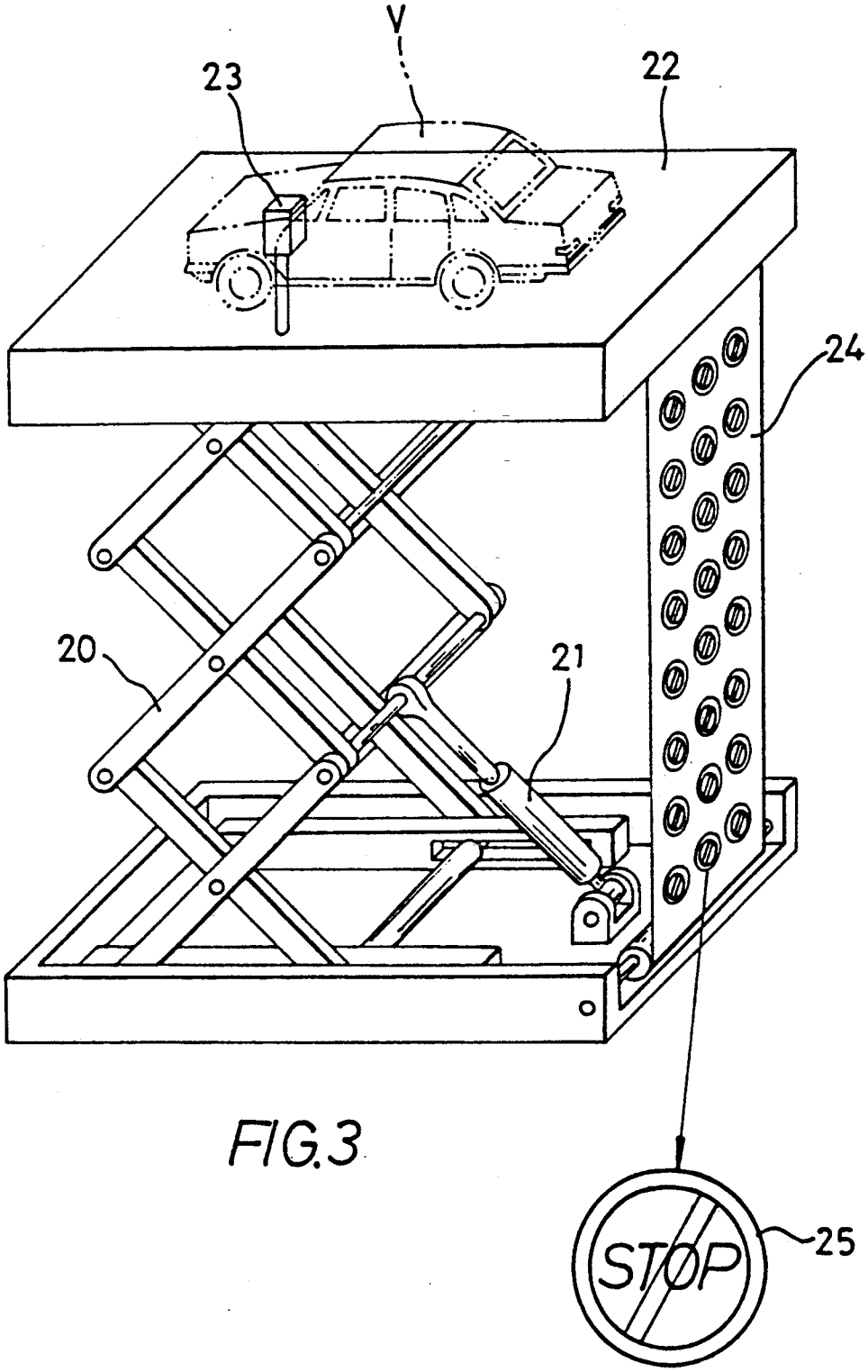
FIG. 3 is a perspective view of the lift conveyer of the automatic roadside parking system.

The lift conveyer 2, as illustrated in FIG. 3, is provided with a lift fee collector 23 which, when a coin is deposited, functions to select a vacant parking platform 11 and to actuate the lift conveyer 2 to ascend to the vacant platform. Also, the lift conveyer 2 is so designed that when the lift conveyer has been raised and remains raised for a pre-set time, about 2–3 minutes, it is released and comes down automatically. This time-period enables a user, after having parked his car, to use the same lift conveyer 2 to come down to the ground level platform 14. This time period is also sufficient to enable the user, when he wishes to withdraw his car, to pay the full parking fees and to drive the car onto the lift conveyer 2, whereby both user and the car can be lowered simultaneously. The lift conveyer 2 may be a hydraulic or air lift system, or it may also be a motor driven reduction screw-rod lift system. In addition, this lift conveyer 2 is provided with a caution curtain 24. This curtain 24 is a spring-operated curtain and is capable of rising or falling along with the ascent or descent of the lift conveyer 2 and it serves to caution any moving car looking for a vacant parking seat at the ground level platform 14 that the lift conveyer 2 in front of the car is on the move. This arrangement serves to prevent any accident which could be caused by the car at the ground level platform running carelessly into or under the moving lift conveyer 2.

The multi-storied roadside parking system of the present invention is also provided with an emergency ladder 6 (see FIG. 2). This emergency ladder 6 is attached to one side of the parking platforms 11 and is for any need to climb up or down the parking racks 1 by the person parking a car.

If all of the vacancy display means 7 beneath the car parking platforms 11 on the second levels of each parking rack 1 of the multi-storied roadside parking system of the invention show a red light, located on any block of a road in a city it indicates that all the car parking platforms 11 in the parking racks 1 on each road block are fully occupied by cars. At this time, all of the lift conveyers 2 within that road block descend to ground level, that is, all of the lift conveyers 2 are now idle. Therefore, cars that are searching for vacant parking platforms in the ground level platforms 14 of all of the parking racks 1 are now able to travel without restriction out of one roadside multi-storied parking system on one road section and enter another roadside multi-storied parking system on the next road section to continue searching for vacant parking platforms.

For lifting and unfolding of the parking racks 1, each rack is fitted and supported on both sides with lazy tong-type links 10 and similar links 20 are also provided on both sides of each of the lift conveyers 2, as shown in FIGS. 1, 2 and 3. Furthermore, an oil cylinder 3 is fitted to each of the parking racks 1 and is driven by an oil pump (not shown) for lifting or unfolding of the foldable rack 1 for parking by remote controller. A similar oil cylinder 21 is also attached to the lift conveyer 2 for raising and lowering the lift conveyer to or from the level of a selected parking platform 11.

The modules of the roadside parking system are each provided on the bottom thereof with a wheeled moving device (not shown) for convenience in adjusting the angle and direction of the individual modules (so as to enable them to be aligned for setting up the system. The wheels of the moving device are spring-released to enable them to flip into a storage recess for stability of the module.

Figure 4:
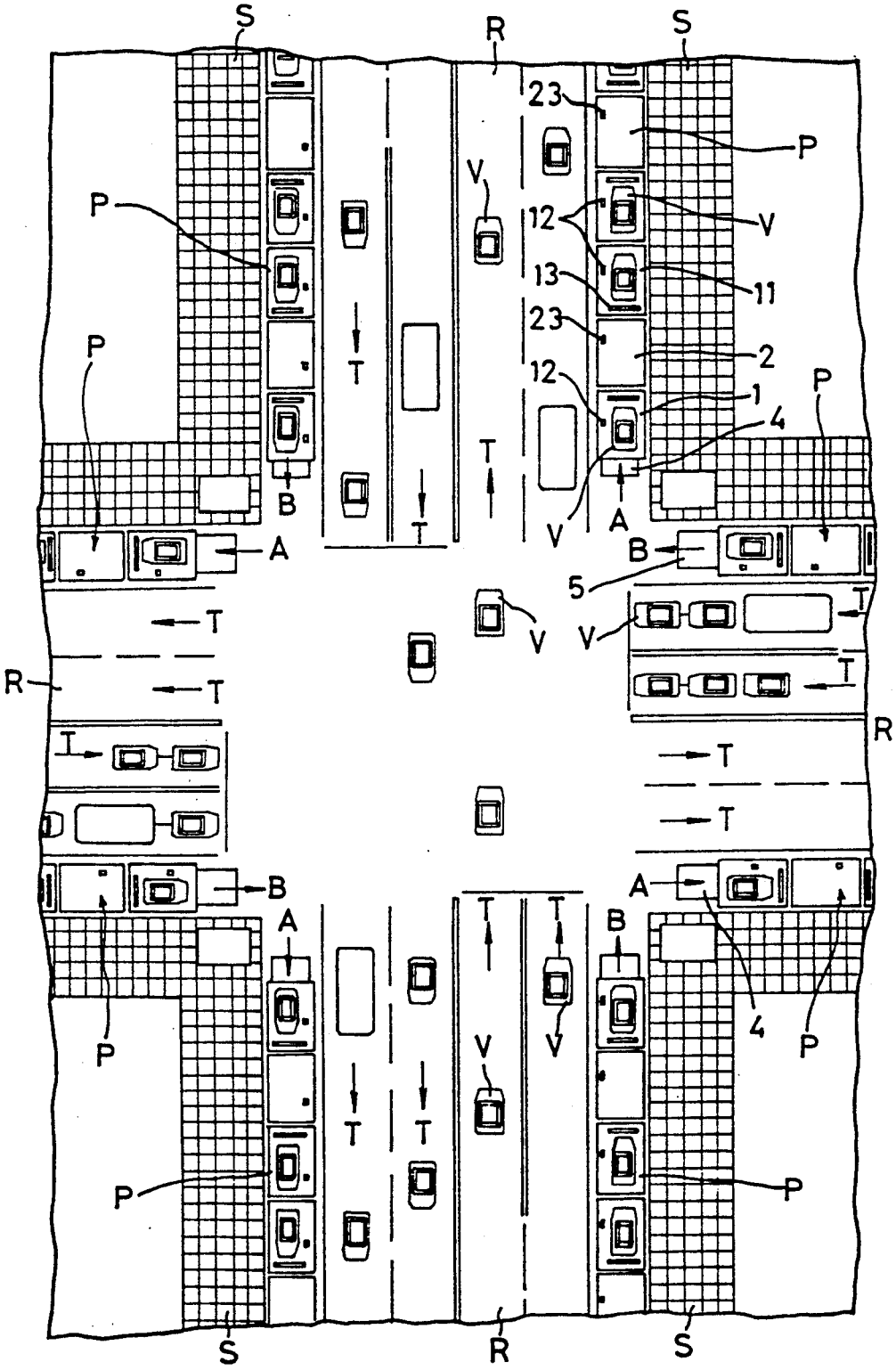
FIG. 4 is a bird's-eye plan view showing an arrangement of the automatic multi-storied roadside parking system of the invention at an intersection.
Figure 5:
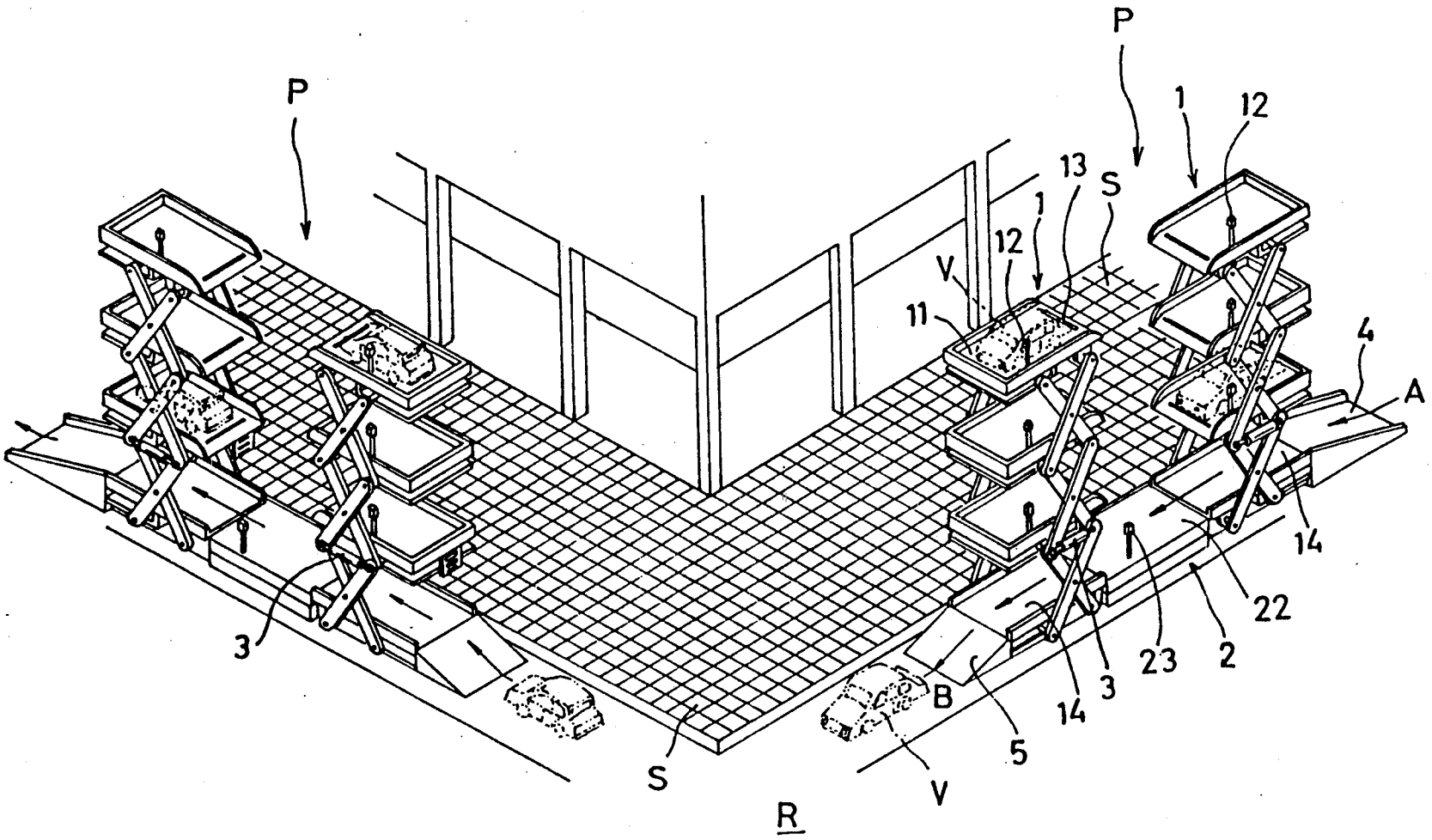
FIG. 5 is a perspective view showing the multi-storied roadside parking system set up at an intersection.

FIGS. 4 and 5 are views showing arrangement of the automatic multi-storied roadside parking system of the present invention at an intersection. In the figures, the reference letter A denotes an ingoing direction, B an outgoing direction, P the parking system, R a roadway, S a sidewalk, T traffic and V a vehicle.

The way in which the multi-storied roadside parking system is arranged is apparent from the plan view of the parking system of the invention as shown in FIG. 4 and the prospective view showing the multi-storied roadside parking systems installed. The most important purpose of the present invention is to develop extra space on the roadside for car parking and to enable cars which are running slowly on the road searching for available parking places but are wasting energy to get parking places close to the destination of the cars. Therefore, when a car looking for an available parking place drives into the multi-storied roadside parking system, the car has achieved some effectiveness by being itself off the road and not blocking other cars for any reason.

With a multi-storied roadside parking system of the present invention described above, the procedure for parking cars is as follows:

Any cars to be parked must drive into the ground level floor 14 of the roadside parking system of the invention and must drive slowly. From the vacancy display means 7 mounted beneath the second level on each of the parking racks 1, the availability of the parking platforms 11 on each level can be determined. When a car has been driven onto the lift conveyer 2 the car must stop and after having deposited coins in the lift fee collector 23 on the lift conveyer 2 the user can then select the vacant parking platform 11 for any floor and push the appropriate button to start the lift conveyer 2. The lift conveyer 2 ascends to the level of the selected vacant parking platform 11 and the user either drives the car forward onto the vacant platform 11 on one side or backward onto the vacant platform 11 on the other side. The lift conveyer 2 having remained for the set time period will descend automatically by itself and the user descends along with the lift conveyer. After the car has been parked on the platform 11, the toll meter 12 mounted on the parking platform 11 will start counting the time, while at the same time, the retardation controller 13 provided on the parking platform 11 is raised in order to prevent the parked car from accidentally rolling off the platform 11. Carrying out the steps described above completes the car parking procedure.

Now, for retrieving the car from the roadside parking system of the present invention, the following steps are followed.

After depositing coins, the lift conveyer 2 is actuated to ascend to the desired level car parking platform. However, before actuating the lift conveyer it is necessary to advise by hand and block any incoming car running along the ground level floor. Next, during the set time period the lift conveyer remains at the raised position, the user pays full the parking fees as shown in the toll meter 12 on the parking platform 11, after which the retardation controller 13 is automatically retracted, and then drives the car off the parking platform 11 onto the lift conveyer 2. The lift conveyer 2 after having remained for the set time period will automatically descend to the level of the ground level 14 of the parking rack. The car may then run slowly forward along the ground level 14 to leave the roadside parking system of the present invention. The foregoing steps complete the process for retrieval of the car.

With the collapsible, removable roadside multistoried parking system of the present invention, each module of the entire system is fully prefabricated and preassembled ready for use. At an appropriate time, for instance, late night or at a time period when people and cars are scarce, several of the parking systems are transported directly to the roadside site prepared beforehand for setting up the present systems and after these systems have been properly arranged and spread out they are ready for use. There is no need for breaking up the ground and there is also nothing to cause a traffic jam. Setting-up can thus be effectively and promptly completed.

While a preferred embodiment of the invention has been shown and described, it will be apparent to those skilled in the art that changes and modifications can be made in this embodiment without departing from the principles and spirit of the invention, the scope of which is defined in the appended claims.

I claim:

1. A multi-storied roadside parking system, comprising:

a pair of spaced end opposed collapsible parking racks each having a plurality of parking platforms which are vertically spaced when said racks are extended;

a lift conveyor positioned between each two adjacent parking racks and capable of ascending and descending stepwise to a level of any of the parking platforms in each rack;

an emergency ladder extending vertically on each rack for use by a person in an emergency;

a moving device on the bottom of each rack and said lift conveyor to facilitate positioning of said racks and said lift conveyor in the parking system;

a vacant platform display means to indicate which parking platforms are vacant;

each parking platform including a retarding means located at an end of each said parking platform which is toward said lift conveyor and which is capable of being raised to prevent a parked car from accidentally rolling off said parking platform and lowered upon payment of parking fees to permit a parked car to move off the platform;

a toll meter on each platform for counting the time a car is parked and for actuating said retarding means when parking fees have been paid to cause said retarding means to be lowered; and said lift conveyor having a coin operated fee collector having a platform selecting function for actuating said lift conveyor to move vertically to a selected platform upon deposit of a coin in the fee collector.

2. A roadside parking system as claimed in claim 1 further including a caution screen associated with said lift conveyor which rises and falls over the ends of said platforms which are toward said lift conveyor during the ascent or descent of said lift conveyor for warning a car searching for a vacant parking platform on a ground level platform that said lift conveyor is lifting or lowering a car.

* * * * *